United States Patent [19]

McLeod

[11] 4,037,521

[45] July 26, 1977

[54] NOISE REDUCTION

[75] Inventor: Donald Patterson McLeod, Cheltenham, England

[73] Assignee: Dowty Hydraulic Units Limited, Cheltenham, England

[21] Appl. No.: 652,314

[22] Filed: Jan. 26, 1976

[30] Foreign Application Priority Data

Jan. 24, 1975 United Kingdom ..... 3221/75

[51] Int. Cl.[2] ..... F01B 3/02; F01B 13/04

[52] U.S. Cl. ..... 91/499; 92/57; 92/71; 92/128; 181/33 K

[58] Field of Search ..... 92/12.2, 71, 148, 128, 92/57; 91/506, 499; 181/33 K, 33 A, 33 D, 198

[56] References Cited

U.S. PATENT DOCUMENTS

| | | | |
|---|---|---|---|
| 2,662,375 | 12/1953 | Postel | 92/12.2 |
| 2,892,413 | 6/1959 | Erikson | 91/499 |
| 3,131,539 | 5/1964 | Creighton | 92/71 |
| 3,495,543 | 2/1970 | Millard | 92/12 P |
| 3,540,425 | 11/1970 | Scheiterlein | 181/33 K |
| 3,667,867 | 6/1972 | Boydell | 91/506 |
| 3,687,224 | 8/1972 | Lundin | 181/33 A |
| 3,774,505 | 11/1973 | McLeod | 91/506 |
| 3,841,203 | 10/1974 | Bruce | 92/73 |

*Primary Examiner*—Martin P. Schwadron
*Assistant Examiner*—Abraham Hershkovitz
*Attorney, Agent, or Firm*—Young & Thompson

[57] ABSTRACT

An axial piston machine comprising a casing which encloses and mounts the machine working parts therein and a cover of pliant material mounted externally of the casing to substantially entrap a quantity of air or other gas against at least a part of the outer surface of the casing to reduce noise radiation from the casing.

6 Claims, 2 Drawing Figures

NOISE REDUCTION

This invention relates to noise reduction in axial piston machines.

In accordance with the present invention an axial piston machine comprises a casing which encloses and mounts the machine working parts therein and a cover of pliant rubber-like material mounted externally of the casing to substantially entrap a quantity of air or other gas against at least part of the outer surface of the casing to reduce noise radiation from the casing.

The main natural frequency of vibration of the cover may be low compared with the normal noise frequencies of the machine.

The casing may be primed with liquid at low pressure. The space between the cover and the casing may include at least one flexible member to maintain the spacing between the cover and the casing.

One embodiment of the invention incorporating an axial piston-hydraulic pump will now be described with reference to the accompanying drawings, in which.

Figure 1:
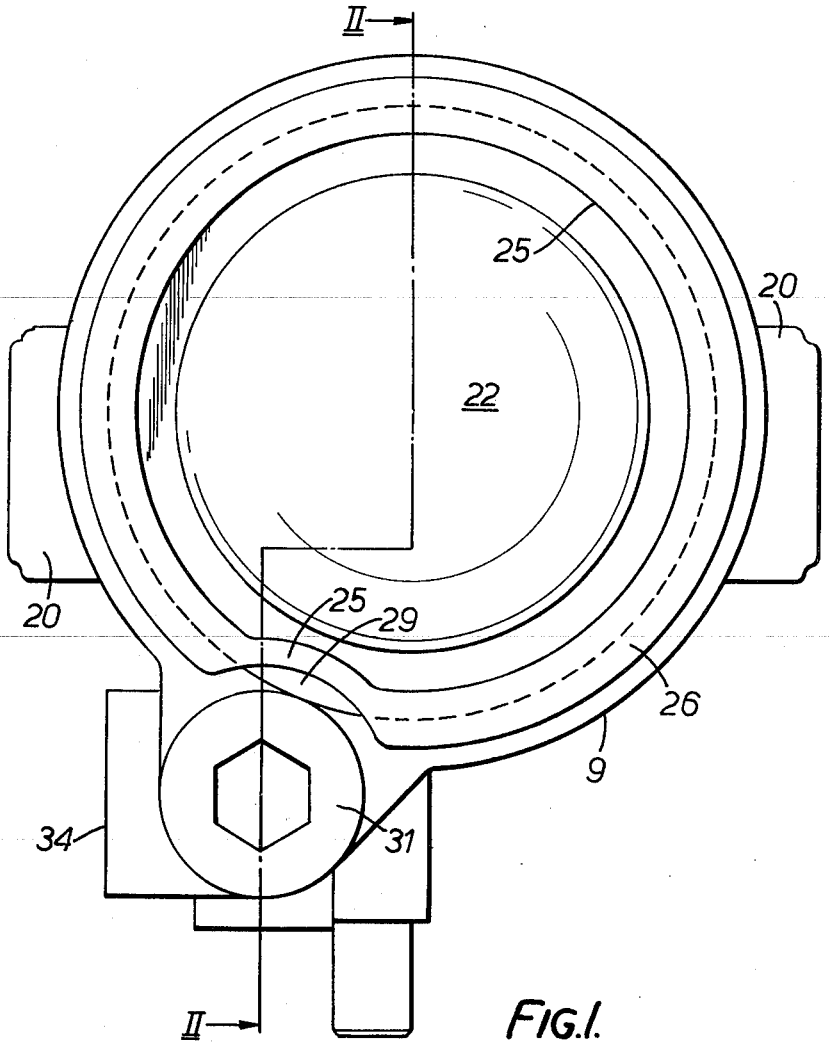
FIG. 1 is an end elevation of the pump.

The axial piston pump shown in the drawing is substantially the same as the pump disclosed in U.S. Pat. No. 3,645,171. Within this pump there is a rotary cylinder block 1 having cylinders 2 directed parallel to the axis of rotation, a piston 3 in each cylinder, an adjustable swash plate 4 having a swash surface 5 engaged by slippers 6 attached by ball joints 7, one to each piston. The cylinder block is rotatable by means of a shaft which can be entered into a splined hole 8 within the cylinder block. The whole pump is contained within a casing 9 of aluminium alloy having a large opening 11 of sufficient size to enable the cylinder block to be inserted into the casing during pump assebly. The cylinder block 1 rotates on a valve surface 12 formed in the casing within which a pair of main ports are located, of which one is the high pressure port indicated at 13 for co-operation with cylinder ports 14 during cylinder block rotation. The part of the casing carrying the valve surface 12 includes a central aperture 15 provided with a seal 16 for entry of the drive shaft in the splined aperture 8 in the cylinder block.

The casing also contains a servo cylinder 17 and a servo piston 18 attached through a link 19 for adjustment of the angular position of the swash plate 4 about a trunnion shaft 21, supported in bearing blocks 20 integrally formed with casing 9. The casing between the blocks 20 and the valve surface 12 is strengthened by external webs to resist the thrust exerted on the swash plate by the pistons. A closure member 22 is provided for closing opening 11. Member 22 is sealed in opening 11 by an O-ring 23 and is removably retained by a wire grip 24 threaded into cooperating grooves around the opening 11 in the casing and around the member 22. The member 22 includes a rim 25 having a flange 26 around its periphery for securing a noise reducing means in position. The noise reducing means comprises a pliant cover 27 of thin rubber or polyvinylchloride material having a peripheral internal recess 28 for engaging over the flange 26, the cover when engaged being without substantial tension. Polyvinylchloride is a particularly good material for the cover since its viscosity causes a high degree of damping.

At one position, in the periphery of the member 22, the flange 26 includes a cut-away portion 29 to clear a boss 31 which projects from the casing 9. At this position, the flange 25 is inwardly curved but nevertheless is integrally formed with the closure member 22. At the position of the cut-away portion 29 the cover 27 includes a simple flange 32 to engage the outer side of the flange 25. The closure member 22 and the cover 27 when engaged together define a completely enclosed volume of air 33, which is hermetically sealed or substantially so by the fitting of the cover 27 onto the member 22.

When the illustrated pump is in operation, the casing 9 is maintained full of liquid at low pressure by means of a connection 34 which connects liquid from a hydraulic reservoir. The illustrated pump is a prolific noise generator particularly when operating at a high delivery pressure. There are many possible causes of this noise but the principal cause of noise generation is thought to be the following. The cylinder block includes five cylinders 2, whose slippers 7 press against the swash surface 5. During rotation of cylinder block 1, for certain parts of the revolution there are only two ports 14 connected to the high pressure port 13 but for other parts of the revolution there are three ports 14 connected to the port 13. During a complete revolution of the cylinder block there are, in fact, ten changes between two and three ports 14 connected to the delivery port 13. For every port 14 connected to the high pressure port 13 the corresponding slipper 7 will exert a heavy thrust on the swash plate. Thus, during rotation of cylinder block 1 there are ten alternations in between two and three of the slippers 7 pressing on the swash plate 4 with corresponding changes in the centre of pressure on the swash plate. As a result the swash plate 4 is subjected to an oscillating thrust and an oscillating movement about its trunnion pin 21, the frequency of this oscillation being the rotational speed of the cylinder block multiplied by the number of pistons in the block. For example, in a pump with a five cylinder block driven at a speed of 3,000 r.p.m. the swash plate 4 will be subjected to an oscillating thrust at a frequency 250 cycles per second. The intensity of this thrust will depend on the output pressure of the pump. The case 9 is full of liquid and the swash plate 4 is closely adjacent to the member 22 which is of substantial area. Normally the pressure of liquid within the casing 9 is maintained at a low value so that there is a constant force urging the member 22 outwardly. Nevertheless the oscillation of the swash plate 4 is transmitted through the casing and the liquid to member 22 and thus to the atmosphere. Many harmonies of the fundamental frequency of 250 c.p.s. are also radiated by member 22. The cover 27 by its location over the member 22 traps the volume of air 33 and the noise generated by vibration of member 22 must now pass through the volume 33 and the cover 27 to the atmosphere. The physical properties of the cover 27 are such that it is itself capable of a natural frequency of oscillation as a diaphragm at only a very low frequency in the order of a few cycles per second only. This natural frequency depends on the elasticity and mass of the cover, the tension in the mounted cover, the volume of air trapped by the cover and by the damping of oscillatory movement of the cover. The effect of damping is to reduce the natural frequency and where the damping exceeds a critical amount the natural frequency may be reduced to zero which for the purpose of the present specification, is considered as a low frequency. The damping may be provided by the viscosity or other internal friction in the material of the cover. Thus the vibration in the volume 33 of the order of 250 cycles per second is not able to cause any substantial vibration in the cover 27 and thus the noise transmitted to the atmosphere from the closure member 22 is very considerably reduced in value.

The cover 27 when located in its operative position should be without any substantial tension since such tension would tend to raise the natural frequency of oscillation of the cover. Nevertheless, some small tension may be present where necessary to ensure location of the cover strongly in its operative position.

In order for the cover to prevent substantial radiation of noise it should have a reasonable thickness and it is found that a minimum effective thickness is about 0.05 inches. There is no real limit to the maximum thickness but, in practice, a substantial thickness of, say, 1 inch does not provide any substantially greater noise reducing effect than a thickness of, say, 0.1 inch.

The volume of air trapped between the member 22 and cover 27 is not critical although it is essential that there should not be direct contact between member 22 and cover 27 within the area surrounded by the flange 25. For preference the spacing between member 22 and cover 27 should not be less than about 0.1 inch and for the sake of compactness in size the maximum thickness of the entrapped air need not exceed about 1 inch.

Figure 2:
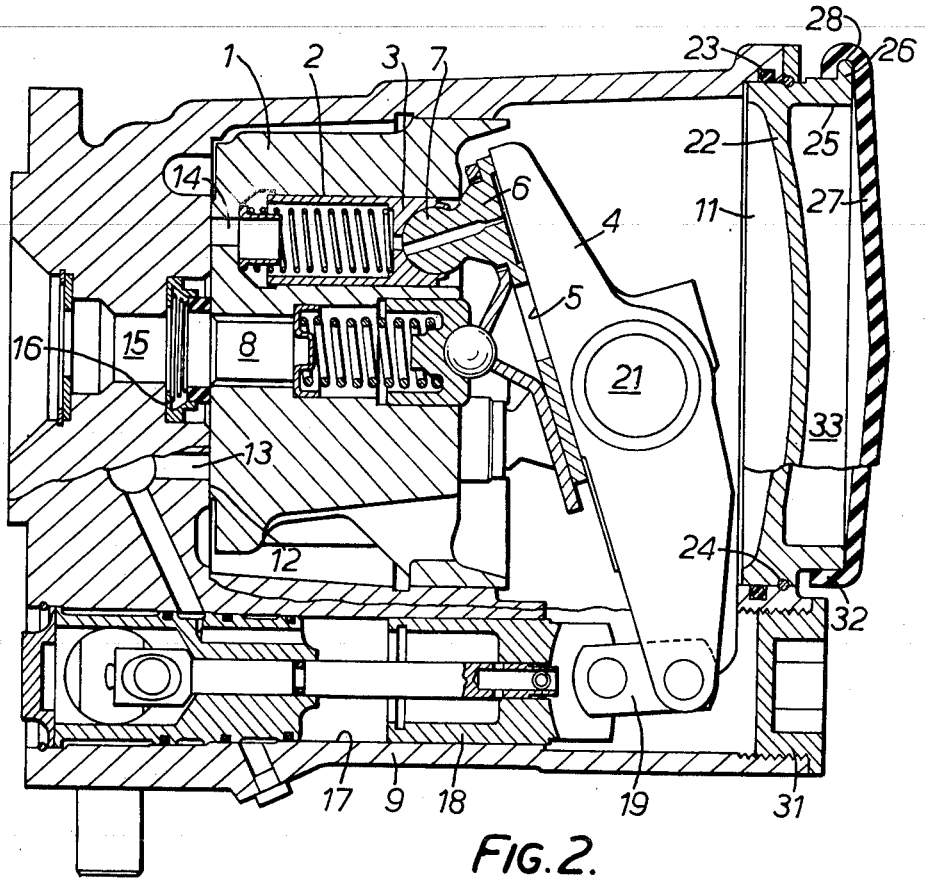
FIG. 2 is a longitudinal cross-section through the pump taken on line II—II of FIG. 1.
Figure 3:
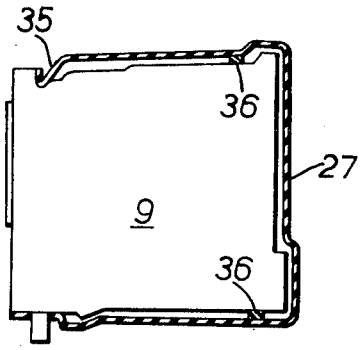
FIG. 3 shows a modified cover applied to the pump of FIG. 1.

Reference is now made to the modified construction illustrated in FIG. 3. Here the axial piston pump is substantially identical with the axial piston pump of FIGS. 1 and 2 with the exception that the removable member 22 does not include the flange 25 or rim 26. The cover 27 in FIG. 3 is moulded to fit around substantially the whole of the casing 9, the part 35 forming the base of the cover 27 being adapted to tightly fit around the base of the casing 9 which is normally intended to be bolted on to a mounting, the drive shaft extending from the mounting through hole 15 in the valve surface 12 and into the cylinder block. Between the cover 27 and the casing 9 one or more flexible members 36 may be located which serve to maintain the air gap between cover 27 and casing 9 without transmission of vibration from the casing to the cover. The members 36 may be of sponge rubber or like expanded material.

As previously explained with reference to FIGS. 1 and 2 the casing will be subjected to vibrations including the fundamental frequency and harmonies of the product of the rotational driving speed and the number of pistons in the cylinder block. While such vibrations will principally cause radiation of noise from the end of the casing adjacent the swash plate 4, i.e. from closure member 22, there is, however, radiation from the remainder of the casing to a lesser degree. The more completely enclosing cover 27 of FIG. 3 more effectively reduces radiation of noise from the casing. The comments made regarding thickness of the cover and thickness of the air spacing with reference to FIGS. 1 and 2 will apply equally to FIG. 3. It will be noted, both in the embodiment of FIGS. 1 and 2 and in the embodiment of FIG. 3, that the cover 27 covers the end of the casing which is opposite the valve plate.

I claim:

1. An axial piston machine, comprising a casing, a cylinder block within the casing, having a plurality of cylinders therein, parallel or nearly parallel to a central axis, a piston in each cylinder, a swash plate located at one end of the cylinder block and engaging the pistons projecting from the cylinders at that end of the block, mounting means for the swash plate in the casing for transmitting to the casing the piston thrusts that act on the swash plate, a valve plate secured within the casing, on which the cylinder block is mounted for rotation, a low and a high pressure main port in the valve plate, a cylinder port from each cylinder opening into the surface of the cylinder block which rotatably engages said valve plate, whereby during rotation, cylinders with outwardly moving pistons are connected to one main port and cylinders with inwardly moving pistons are connected to the other main port, a drive shaft passing through the valve plate to rotate the cylinder block, the casing having a closure member at an end which is opposite the valve plate, a cover of pliant material mounted on one of said closure member and said casing and externally of the casing adjacent to the swash plate and together with said closure member covering said end of the casing which is opposite the valve plate, said cover covering said closure member, and a quantity of air or other gas trapped by the cover against the external surface of the closure member, the natural frequency of vibration of the cover being low compared to the natural frequency of the material used for the casing.

2. An axial piston machine as claimed in claim 1, wherein the said closure member is removable from the casing, removal of the member providing a hole in the casing of a size to permit insertion of the block and swash plate into their operative positions within the casing.

3. An axial piston machine as claimed in claim 2, wherein the casing contains liquid at low pressure.

4. An axial piston machine as claimed in claim 1, wherein the pliant cover is moulded from polyvinylchloride.

5. An axial piston machine as claimed in claim 2, including a wire grip and co-operating grooves around the opening in the casing and around the closure member, the wire grip serving, when threaded into said co-operating grooves, to retain the closure member in position in the opening.

6. An axial piston machine as claimed in claim 5, wherein the removable closure member is externally provided with a rim and a flange by which the pliant cover is mounted in spaced, relation to the member, such mounting, substantially entrapping a quantity of air between the member and the cover.

* * * * *